US006461284B1

(12) United States Patent
Francavilla

(10) Patent No.: US 6,461,284 B1
(45) Date of Patent: Oct. 8, 2002

(54) SPHERICAL BACK EXERCISER APPARATUS

(76) Inventor: John Joseph Francavilla, 2325 Desota Dr., Ft. Lauderdale, FL (US) 33301

( * ) Notice: Subject to any disclaimer, the term of this patent is extended or adjusted under 35 U.S.C. 154(b) by 0 days.

(21) Appl. No.: 09/943,228

(22) Filed: Aug. 30, 2001

(51) Int. Cl.[7] ..... A63B 21/00

(52) U.S. Cl. ..... 482/142; 482/130; 482/907; 482/121

(58) Field of Search ..... 482/142, 907, 482/130, 148, 121, 123, 126, 133, 134; 297/452.41, 452.1, 452.17; 248/562, 599; 472/134, 135, 127

(56) References Cited

U.S. PATENT DOCUMENTS 4,191,178 A 3/1980 Wisnieski
5,690,389 A * 11/1997 Ekman et al. ..... 297/452.41
5,728,031 A 3/1998 Honeycutt
5,833,587 A * 11/1998 Strong et al. ..... 482/123
6,070,943 A * 6/2000 Guery-Strahm ..... 297/452.41

FOREIGN PATENT DOCUMENTS

GB 2226769 * 4/1990 ..... 482/123

* cited by examiner

*Primary Examiner*—Jerome W. Donnelly
(74) *Attorney, Agent, or Firm*—McHale & Slavin

(57) ABSTRACT

An exercise apparatus for developing flexibility and strength in the back and abdominals. The apparatus uses a captured ball to support the user's body. The ball is mounted in a receptacle with a substantial portion, of the sphere exposed for contact with the user's body. The sphere has universal movement in the receptacle. In use, the user sits or lies on the ball with their back-in contact with the exposed sphere and their feet on the, floor or a foot rest. The body is exercised by maintaining a point of contact between the ball and the user's back.

14 Claims, 5 Drawing Sheets

SPHERICAL BACK EXERCISER APPARATUS

FIELD OF THE INVENTION

This invention relates to the field of exercising devices and more particularly to exercise apparatus used to strengthen back muscles, add flexibility to the spine and abdominals, and to increase range of motion.

1. Background of the Invention

Back pain is a predominant complaint of patients seen by chiropractors, orthopedic surgeons and other professionals who deal in physical fitness/rehabilitation. The causes of back pain are varied, including injury, congenital defects, and bad habits. For example, individuals with poor posture place excessive pressure on the intervertebral disks and nerves related to the soft tissue of the back.

An integral part of any rehabilitation of the back and spine, regardless of the cause of the problem, is some form of exercise to strengthen and increase the flexibility of the back. Exercises and exercise equipment should result in movement of the spine to bend forwardly, rearwardly, and from side to side. Bending rearwardly is especially helpful in relieving pressure on the disks.

2. Description of the Prior Art

One method of exercise that is well known employs a large ball, sometimes called a Fit Ball, that is placed between a user's back and a vertical surface, such as a wall. The user assumes a squat position and pushes against the ball with his legs and back. The exercise requires the individual to apply sufficient pressure to prevent the ball from dropping through the application of pressure, while using their legs to move the ball for receipt of the exercise effect. Should the ball fall or otherwise loss contact, the individual could injure themself if their physical aliment was of a type that would not allow for sudden movements.

In another embodiment, a larger ball my be use on the floor or the like horizontal surface. As the ball rolls about the surface, the user maintains contact by flexing muscles and the skeleton. In this embodiment, the individual may sit on the ball wherein muscle exercise maintains the individual in an upright position providing spine movement and associated flex movement. The ability for an individual to maintain a position on the ball depends on their balance since the curvature of the ball requires balance at the base and apex of where the individual is situated. If an individual employs the ball to work the back, movement of the ball is necessary. However, excess movement may cause the individual to fall of the ball defeating any beneficial effects.

If the individual has certain physical handicaps, the current ball exercise device could not occur with the assistance of support personnel. This makes the use of current ball technology limited to those persons who have the assistance of support personnel or risk injury to themselves while attempting a rehabilitation.

U.S. Pat. No. 6,231,489 B1 discloses a back exercise machine which has a base for support of the machine. Attached to the base is an array of parallel rollers upon which the user rests the back in the supine position. The rollers terminate adjacent to a seat and extending from the seat, opposite from the rollers, is a bar for securing the user's feet. The user may sit in the seat and place his feet on the bar, bending rearwardly to allow the rollers to engage his back. This motion decompresses the spinal disks.

U.S. Pat. No. 4,191,178 discloses the use of a sphere or ball to massage the feet. The ball has a circumference of approximately 15 to 20 inches with protuberances to engage the feet.

U.S. Pat. No. 5,728,031 discloses an abdominal exerciser employing a vertical frame extending from a base mounted on the floor. Within the frame, is a pivotally mounted sphere that impacts the abdomen when the upper portion of the frame is pushed away from the user.

Thus, what is needed is an exercise apparatus that reacts with universal motion when forcibly contacted by an individual requiring equal and opposite body movements in all axes to maintain the point of contact.

SUMMARY OF THE INVENTION

An exercise apparatus for developing flexibility and strength in the back. The apparatus employs a frame that captures an exercise ball in either an upright or angled position for support of the user's body. The ball is mounted in a receptacle with a substantial portion of the sphere exposed for contact with the user's body. The sphere has universal movement in the receptacle or may remain in a fixed position. In use, the user sits or lies on the ball with their body in contact with the exposed sphere with feet on the floor or a foot rest. The body is exercised by maintaining a point of contact between the ball and the user's back.

Accordingly, it is an objective of the instant invention to teach an exercise device having a captured ball housed within a receptacle or cage. The ball provides a re-active surface to the movement of weight placed on its circumference, either by deformation or by rotation or both.

Still another objective of the instant invention is to provide an exercise apparatus having a primary purpose of increasing flexibility and strength in the back and spine of a person whose motion is limited by injury, surgery, congenital defects or lack of conditioning.

It is a further objective of the instant invention to teach universal movement of the captured ball in response to physical movement of an exerciser in contact with the exposed portion of the sphere.

It is yet another objective of the instant invention to teach a cage with an open mouth housing the ball with a portion of the ball exposed for contact by an exerciser.

It is a still further objective of the invention to teach a frame supporting the cage and containing implements used by an exerciser to translate physical force to the ball for universal motion or deformation.

Another objective of the invention to disclose a frame having hand and/or foot supports that allow an individual to maintain a position on the captured ball without assistance from other individuals.

Still another objective of the instant invention is to provide an exercise apparatus having a fully adjustable leg lift attachment that can also rotate.

Another objective of the instant, invention is to provide an exercise apparatus having a fully adjustable resistance ban attachment.

Another objective of the instant invention is to provide an exercise apparatus having hand rails.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

Figure 6:
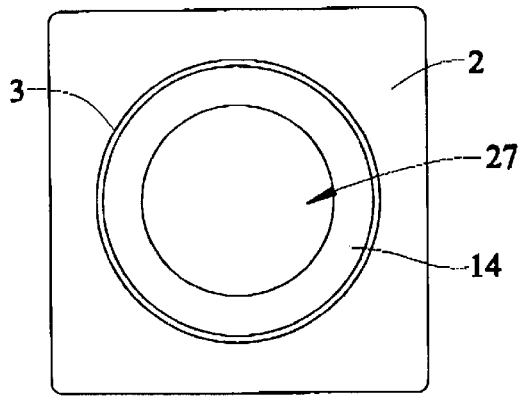
Figure 4:
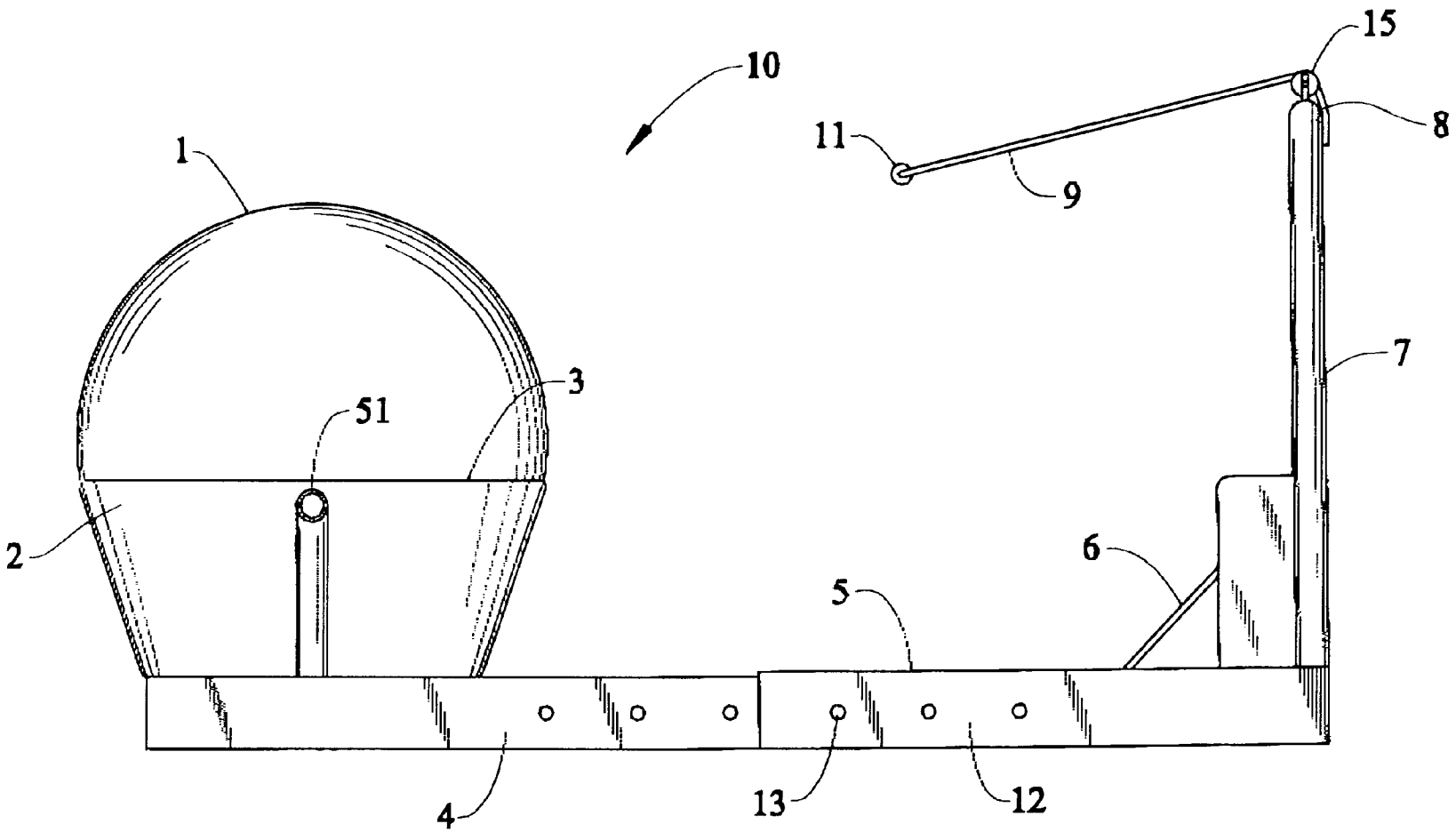
FIG. 4 is a perspective view of another embodiment of the invention.

FIG. is the embodiment depicted in FIG. 4 with the cage rotated;

FIG. 6 is a top view of the receptacle; and

Figure 7:
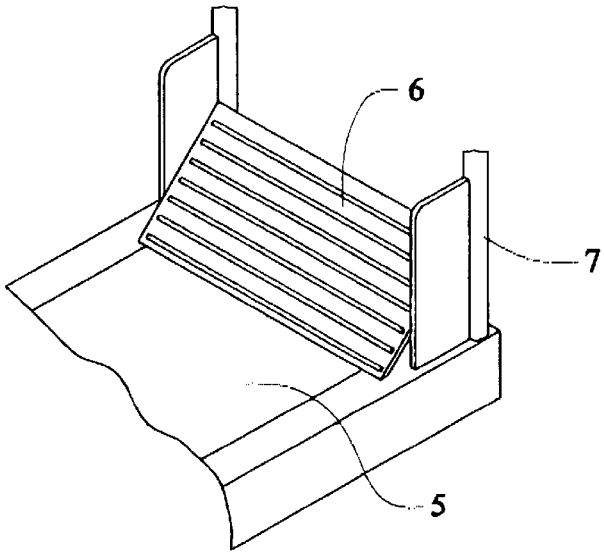

FIG. 7 is a perspective of the foot rest.

DETAILED DESCRIPTION OF THE INVENTION

The exercise device 10 has a primary purpose of increasing flexibility and strength in the back and spine of a person whose motion is limited by injury, surgery, congenital defects or lack of conditioning. While the use of the device focuses on the back, the device may be used to exercise other parts of the body. Indeed, proper use of the device obviously requires coordinated action from other parts of the body.

Figure 1:
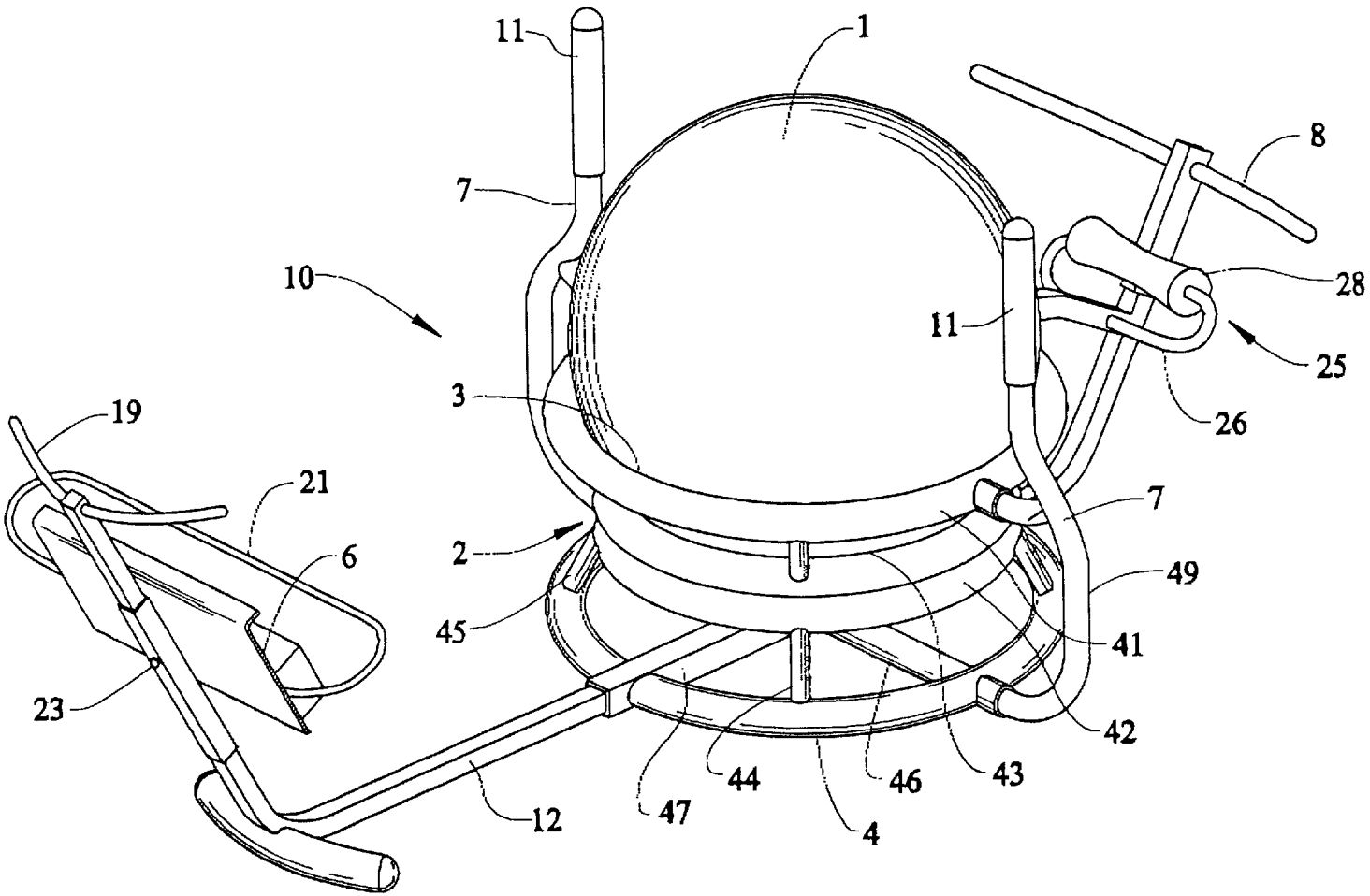
FIG. 1 is a perspective of one embodiment of the invention.

The basic apparatus is shown in FIG. 1. A large ball or sphere 1, approximately 2 foot diameter, is captured in a cage 2 which may consist of a solid wall such as that of a bucket shape, or be formed of a tubular shape that assimilates the contain function of a bucket with walls. The ball 1 may be a hollow sphere filled with a gas, fluid or it may be solid. The spherical outside wall may be smooth or roughened for better purchase. The sphere 1 is preferably resiliently deformable but will not lose it's shape when supporting the weight of an exerciser.

The cage 2 supports the sphere on an exercise surface, such as a floor. The cage 2 has an open mouth 3 which is sized to accept the circumference of the ball 1 and can secure the ball 1 in affixed position. Alternatively the cage 2 can allow the ball 1 of universal rotation or surface deformation of the ball within the cage. The open mouth is formed by a circular frame member 41. Smaller, horizontal, parallel, circular frame members 42 and 43 contact the spherical surface of the ball 1. The circular frame members are held in spatial relationship by vertical members such as those depicted by numerals 44 and 45, others (not shown) are spaced about the circumference of the horizontal frame members. The cage 2 has a circular frame support surface 4, contacting the floor, which is of a size-to stabilize the apparatus so that rotation or deformation of the sphere does not cause lateral movement of the receptacle. The circular frame support surface 4 is reinforced by radial frame members 46 and 47, and others. Radial frame member 47 is connected to the extension 12 which is connected to the foot rest 6. The extension 12 is adjustable so as to accommodate the leg reach of an individual using the ball 1 for exercise and the secondary foot rest 6. The foot rest may include a. bracket 21 allowing an individual to lock their feet into position. Rotating knob 23 allows the foot rest 6 and bracket 21 to rotation ninety degrees to allow a side work out. Handle bar 19 allows a fixed item to grasp when positioning of the feet or body to the apparatus.

Radial frame member 46 is connected to the vertical support 49 of the hand bar 11. The handles being fully adjustable in the vertical format. Other radial frame members are connected to the vertical supports for the handle bars. The handle bars 11 provides an area for an individual to grasp for support while situated on the ball 1 in an upright or reclined sitting position. Cross bar 8 provides, an area for an individual to grasp for support while laying on the ball 1 wherein the individuals chest is used to contact the ball in a frontal position. A head rest 25 is provided by placement of a head cushion 28 beneath the handle bar 8 as support by bracket 26.

Figure 2:
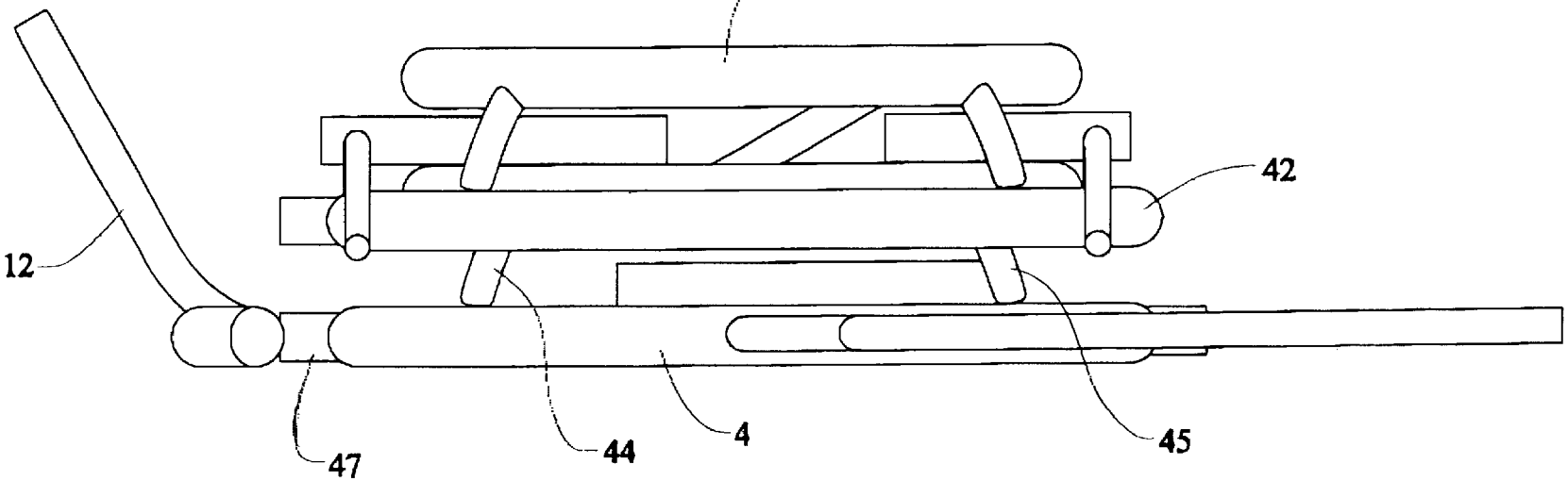
FIG. 2 is a side view of the base depicted in FIG. 1, in a storage position.

FIG. 2 shows the invention of FIG. 1 disassembled into component pieces of circular frame members with attached frame stubs and stacked to provide a compact storage form for the exerciser.

Figure 3:
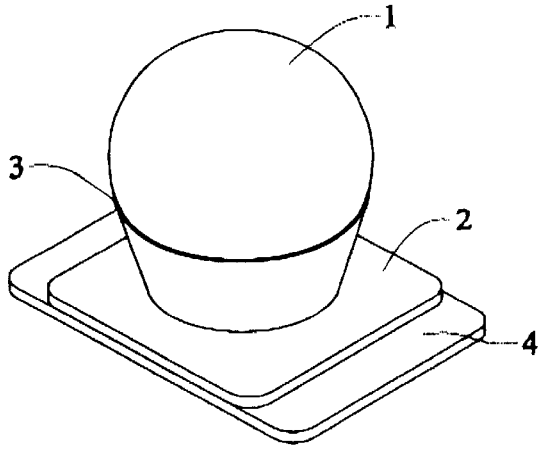
FIG. 3 is a perspective of a simplified ball holder.

FIG. 3 is another embodiment depicting the apparatus with a simplified base formed from a bucket shaped container. An individual may place the device 10 near a vertical wall at a distance somewhat less than the length of the exerciser's legs. The exerciser would then sit on the floor with his/her back against the device and-his/her feet against the wall with slightly bent legs. By straightening the legs the exerciser's back is forced against the sphere causing the sphere to deform or rotate or both. As the sphere deforms and/or rotates, the exerciser must apply muscular force to compensate for, the shifting location of the point of contact between the body and the ball to avoid dislodgement. Rather than placing the feet against an opposing wall, the more agile exerciser can place his/her feet flat on the floor. Since there is no limit to the direction of deformation or rotation, the exerciser must move in all axes. Further, the device can be used, by an individual for sitting on wherein balancing, with or without the wall support, provides the desired flex exercise. The device shown illustrated in FIG. 1 and 2 provide a larger range of motion, to the user, than the modifications shown in FIG. 3. Because of this freedom, the device of FIG. 3 may be above the physical ability of some exercisers.

The embodiment set forth in FIG. 4 has a solid wall for housing the ball and is used to stabilize the ground apex of the exerciser ball during use of the device by an individual. As with the apparatus illustrated in FIG. 1, the support surface 4 has an adjustable extension 12 to accommodate individuals having various leg lengths. The supporting surface 4 and extension 12 have cooperating stops 13 to releasably fix the length of the supporting surface. At one end of the support surface is the receptacle 2 housing the ball 1. At the other end is a foot rest 6, also shown in FIG. 7, which provides an inclined surface facilitating the position of the feet during application of force against the ball 1. The foot rest is fully adjustable providing a leg lift attachment.

For further assistance to the exerciser, a vertical frame 7 extends upwardly from the extension 12 of the supporting surface 4. The frame 7 is generally U-shaped with adjustable vertical sections on each side of the foot rest 6 joined by a horizontal section or handle bar 8. Attached to the handle bar 8 is a flexible tether 9 which may extend toward the sphere 1. The exerciser may grasp the tether by the handle bar 11 and with the feet on the foot rest, gradually lean backwards until contacting the ball. In FIG. 1, the frame 7 has a handle bar 8. A tether (not shown) can be attached to this-cross bar.

The exerciser may be restricted in the use of the lower legs for applying force to the ball. In this situation, the extension 12 may be shortened and the exerciser may place the thighs between the foot rest 6 and the handle bar 8. In FIG. 1, the exerciser may place his thighs under the cross bar 8.

The tether 9 is attached to the handle bar 8 through a rotatably mounted pulley 15. The pulley may be locked in place or rotate to lengthen or shorten the tether. The pulley 15 may have adjustable resistance by connection of the tether to weights or through spring resistance in the pulley. For instance, the tether may be an elastic rope that provides the resistance or a non-elastic line that secures to weights, springs, or the like resistance items.

Figure 5:
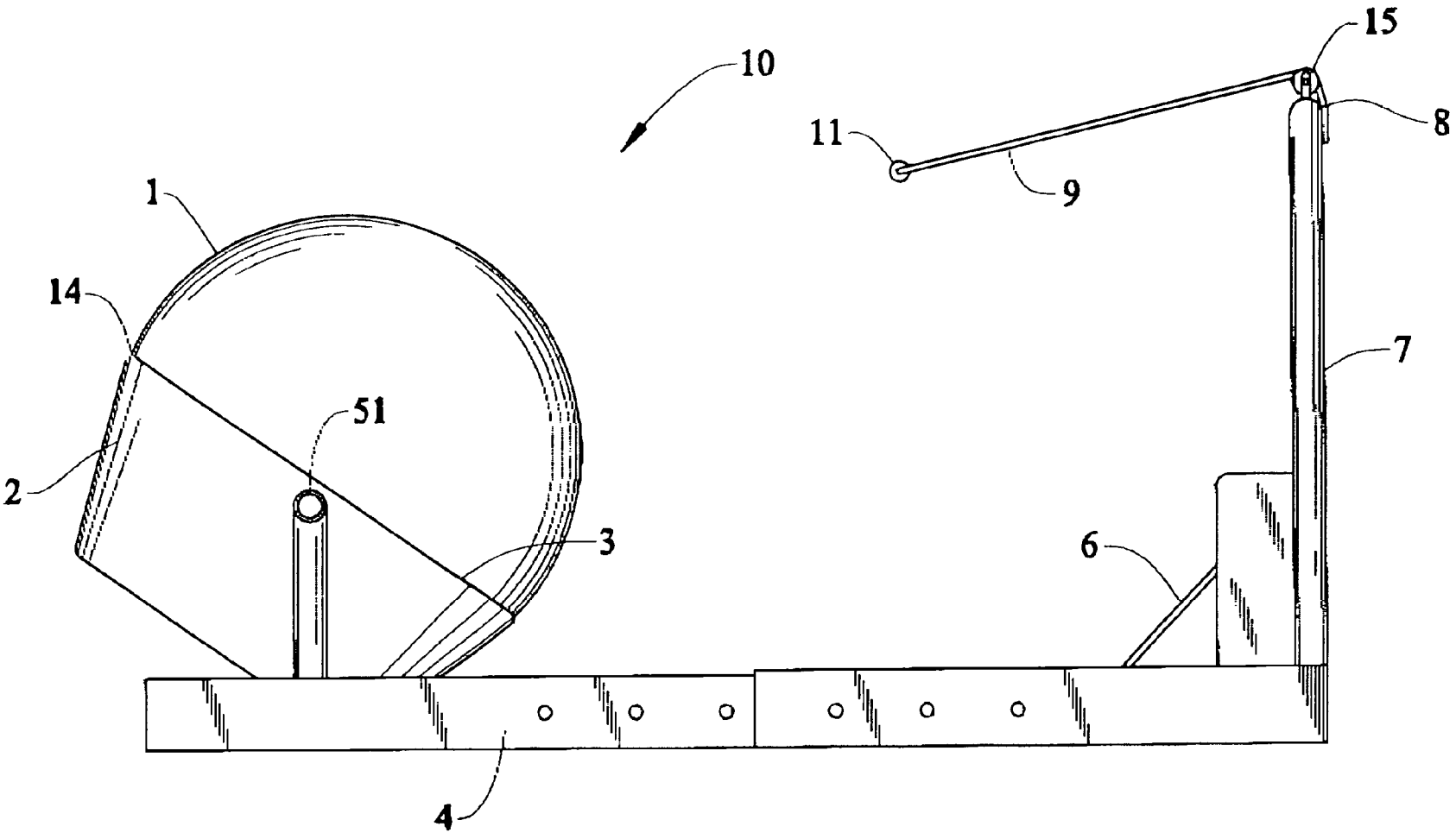

In FIG. 4, the mouth 3 of the receptacle is illustrated as approximately parallel to the supporting surface 4 however, the mouth of the receptacle may have other angular orientations to the supporting surface, as shown in FIG. 5. The cage 2 may be pivoted about the axle 51 to permit changing the orientation of the mouth 3. The mouth 3 has an inner collar 14 which forms a circumferential seal with the sphere. If rotation is desired, the lubricious material of the collar 14 functions to facilitate universal movement of the sphere 1. The collar 14 may be selectively adjusted to provide varying degrees of resistance to the rotation of the sphere. If deformation of the surface of the ball is used for exercise, the collar is formed to prevent rotation. The weight of the user will wedge the ball tightly into the circular frame member 41.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. An exercise device comprising an elongated frame, said elongated frame having an underside for supporting the device and an upper side carrying exercise components, said exercise components including a cage having an open mouth housing a sphere, the depth of said cage being less than the diameter of said sphere, the circumference of said open mouth of said cage closely circumscribing the circumference of said sphere to capture said sphere whereby a user apply force to said sphere causing movement of said surface of said sphere resulting in exercise of the body in all axes to maintain contact between said sphere and the user further comprising an exercise component in the form of a handle bar, said handle bar attached to said elongated frame at said one end, said handle bar disposed in a manner to provide a manual support for the user to maintain contact between said sphere and the user's back and further comprising an exercise component in the form of a rotatable foot rest, said foot rest attached to said elongated frame at said one end, said foot rest disposed in a manner to provide user support in the same plane as the device.

2. An exercise device of claim 1 wherein said foot rest includes a support bar for securement of the individual's foot against the footrest.

3. An exercise device of claim 1 further comprising a flexible tether attached to said handle bar at either end, said tether being adjustable in length, a grip attached to said tether at the other end, said grip to provide manual support for the user in all axes.

4. An exercise device of claim 1 further comprising a plurality of stops in said elongated frame, said plurality of whereby the distance between said cage and said foot rest may be changeably set.

5. An exercise device of claim 1 further comprising said exercise components including at least one hand rail mounted on said cage.

6. An exercise device of claim 1 further comprising a reel in said handle bar, said tether wrapped about said reel, said reel including adjustable resistence for lengthening and shortening said tether resulting in exercise of the body in all axes.

7. An exercise device comprising an elongated frame, said elongated frame having an underside for supporting the device and an upper side carrying exercise components, said exercise components including a cage having an open mouth housing a sphere, the depth of said cage being less than the diameter of said sphere, the circumference of said open mouth of said cage age closely circumscribing the circumference of said sphere to capture said sphere whereby a user apply force to said sphere causing movement of said surface of said sphere resulting in exercise of the body in all axes to maintain contact between said sphere and the user, said cage further comprising a collar being adjustable to decrease or increase the amount of force required to rotate said sphere.

8. An exercise device of claim 1 further comprising said sphere being resilient, said resilient sphere adapted to support a user's weight and maintain universal movement in said mouth of said receptacle.

9. An exercise device of claim 1 including a head rest coupled to a handle bar support post.

10. An exercise device adapted for floor exercises said device comprising a sphere capable of supporting the weight of a user, a receptacle housing said sphere, said receptacle having an open mouth, said open mouth exposing a portion of said sphere, said sphere mounted in said mouth of said receptacle for universal rotation, said receptacle having a support surface opposite said open mouth, said receptacle movably mounted on said support surface, said support surface adapted for stationary contact with the floor whereby a user may place the sphere in supporting contact with the body and exercise in all axes by maintaining contact with said sphere while said sphere rotates universally.

11. An exercise device of claim 10 wherein said receptacle is movable to orient said mouth in adjustable angular relation to said floor.

12. An exercise device for improving strength and flexibility of the body by continuous contact with a universally moving spherical surface through muscular responses to maintain equilibrium, said exercise device comprising a cage for capturing a sphere with a substantial portion of the surface of said sphere exposed, said cage having a plurality of parallel circular frame members, a lower parallel circular frame member adapted to support said device, said lower parallel circular frame member having radial frame members extending from the center to the periphery, said radial frame members connected to vertical frame members extending approximately normal to said parallel circular frame members about said periphery, said vertical frame members connected to said plurality of parallel circular frame members about said periphery and securing said plurality of circular frame members in said parallel relationship, an upper parallel circular frame member forming the mouth of said cage, said vertical frame members attached to accessories extending beyond said upper parallel circular frame member, said accessories adapted to facilitate maintaining equilibrium.

13. An exercise device of claim 12 wherein one of said radial frame members forms an extension beyond said periphery of said lower parallel circular frame member and is attached to a foot rest, said extension being adjustable.

14. An exercise device of claim 13 wherein said device is easily dissembled with said vertical frame members detachably connected to said radial frame members and said accessories detachably connected to said vertical frame members and said vertical frame members detachably connected to each other between said plurality of parallel circular frame members.

* * * * *

UNITED STATES PATENT AND TRADEMARK OFFICE

CERTIFICATE OF CORRECTION

PATENT NO. : 6,461,284 B1
DATED : October 8, 2001
INVENTOR(S) : Francavilla

It is certified that error appears in the above-identified patent and that said Letters Patent is hereby corrected as shown below:

Column 5,
Line 17, cancel "said"
Line 43, cancel "said one" and insert -- the other -- therefor.

Signed and Sealed this

Twenty-fifth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,461,284 B1
DATED : October 8, 2001
INVENTOR(S) : Francavilla

It is certified that error appears in the above-identified patent and that said Letters Patent is hereby corrected as shown below:

Column 5,
Line 37, cancel "said"
Line 43, cancel "said one" and insert -- the other -- therefor.

This certificate supersedes Certificate of Correction issued November 25, 2003.

Signed and Sealed this

Twenty-seventh Day of April, 2004

JON W. DUDAS
*Acting Director of the United States Patent and Trademark Office*